United States Patent [19]

Kleber et al.

[11] 4,278,773

[45] Jul. 14, 1981

[54] DISPERSIBLE COMPOSITIONS OF FLUOROCARBON RESINS

[75] Inventors: Rolf Kleber, Neu-Isenburg; Lothar Jaeckel, Flörsheim am Main, both of Fed. Rep. of Germany

[73] Assignee: Hoechst Aktiengesellschaft, Fed. Rep. of Germany

[21] Appl. No.: 13,913

[22] Filed: Feb. 22, 1979

[30] Foreign Application Priority Data

Feb. 25, 1978 [DE] Fed. Rep. of Germany ..... 2808157

[51] Int. Cl.[3] ..... C08K 5/16; C08L 27/12; C08F 14/18

[52] U.S. Cl. ..... 525/6; 260/18 N; 260/29.6 F; 260/29.6 PM; 526/242; 526/247; 526/248; 526/249; 528/492; 528/494; 528/401

[58] Field of Search ..... 260/29.6 F, 29.6 PM, 260/29.6 MN, 29.6 ME, 18 N; 526/6, 242, 247, 248, 249; 528/492, 401, 494; 525/6, 418

[56] References Cited

U.S. PATENT DOCUMENTS

| | | | |
|---|---|---|---|
| 3,896,071 | 7/1975 | Poirier | 260/29.6 F |
| 3,959,229 | 5/1976 | Downing et al. | 526/242 |
| 4,032,495 | 6/1977 | Perronin et al. | 260/29.6 F |
| 4,075,237 | 2/1978 | Kleiner et al. | 526/242 |

FOREIGN PATENT DOCUMENTS

| | | | |
|---|---|---|---|
| 1190542 | 5/1970 | United Kingdom | 526/6 |

*Primary Examiner*—John Kight, III
*Attorney, Agent, or Firm*—Connolly and Hutz

[57] ABSTRACT

Easily dispersible compositions of (a) one part by weight of fluorocarbon resin, (b) from 1 to 10 parts by weight of a compound of the general formula

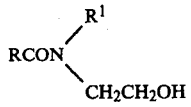

in which R is $C_8$–$C_{22}$ alkyl or alkenyl and $R^1$ is hydrogen or hydroxyethyl, and (c) from 1 to 10 parts by weight of a compound of the general formula $$R—(O—CH_2—CH_2)_x—OH$$

in which R is $C_8$–$C_{22}$ alkyl or alkenyl and x is a number of from 15 to 50, preferably from 20 to 30.

These compositions, which are prepared by melting the fluorocarbon resin together with the compounds (b) and (c), are readily dispersible in water and the obtained dispersions, which are stable to storage are used for the dirt-repelling finishing of textiles, leather or paper and as fiber conditioning compositions.

9 Claims, No Drawings

DISPERSIBLE COMPOSITIONS OF FLUOROCARBON RESINS

The present invention relates to dispersible compositions of fluorocarbon resins.

From German Offenlegungsschrift No. 2 628 776 fluorocarbon resins have been known which impart to thermoplastic materials, especially synthetic fibers, dirt-repellent properties. Said fluorocarbon resins are applied from aqueous baths onto the fiber material, however, it being required for this purpose that the fluorocarbon resins are dispersed before with a dispersing agent in water. However, the selection of appropriate dispersing agents is very difficult, since due to their strong hydrophobic properties the fluorocarbon resins require emulsifying or dispersing agents with low HLB values, which are able to mix with these fluorocarbon resins, whereas a high HLB value is required for the incorporation of the substances into the aqueous phase. In Example 8 of said German Offenlegungsschrift No 2 628 776 the use of lignosulfonate as dispersing agent for these fluorocarbon resins has been described. On the other hand, said lignosulfonates are hardly appropriate for this purpose, since the dispersions of fluorocarbon resins prepared with the same are not stable.

It has now been found that stable dispersions of these fluorocarbon resins in water can be prepared, if as dispersing agent there is used a mixture of fatty acid mono- or diethanolamide and an oxethylated fatty alcohol.

The subject of the present invention are therefore compositions consisting of (a) from 1 to 10 parts by weight of a compound of the general formula

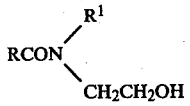

in which R is $C_8$–$C_{22}$ alkyl or alkenyl and $R^1$ is hydrogen or hydroxyethyl, (b) from 1 to 10 parts by weight of a compound of the general formula $$R—(O—CH_2—CH_2)_x—OH$$

in which R is $C_8$–$C_{22}$ alkyl or alkenyl and x is a number of from 15 to 50, preferably from 20 to 30, and (c) 1 part by weight of a fluorocarbon resin consisting of at least one fluorinated compound with at least one benzene nucleus and (1) one or two carbonyl groups as substituents at this benzene nucleus, wherein the carbonyl groups are bound via an oxygen or a nitrogen atom to a perfluoroalkyl or perfluoroalkylene-oxyperfluoroalkyl radical of from 2 to 20 carbon atoms and, if each benzene nucleus does not contain more than one carbonyl group of this kind, the number of benzene nuclei is at least 2, and (2) further carbonyl groups arranged each in the ortho-position to a carbonyl group, and only to one of the first-mentioned carbonyl groups, the number of the former groups not exceeding the number of the first-mentioned carbonyl groups, these additional carbonyl groups being bound each via an oxygen atom to an esterifying bivalent alkylene radical of from 1 to 5 carbon atoms which binds the oxygen atom to (a) at least one further benzene nucleus substituted in similar manner, or (b) an alkyl group of from 1 to 5 carbon atoms substituted at least once by a hydroxyl group, a halogen atom or a terminal epoxy ring, or (c) two alkyl groups of this kind which are bound to each other by an oxygen atom.

The fluorocarbon resins used in accordance with the present invention may be further described by the following formulae I, II and III:

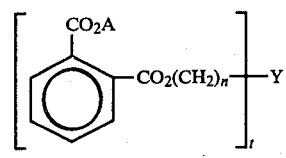

I.

in which n is a number of from 1 to 4, t is a number of from 2 to 4, Y is CHOH, CH, COH or C, and A is a fluorinated esterifying radical as it has been specified under (1) of the above general definition,

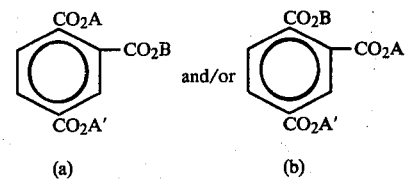

II.

in which A and A′ represent identical or different fluorinated esterifying radicals, as they have been specified under (1) of the above general definition, and B is an esterifying radical, as it has been specified above under (2) of the general definition,

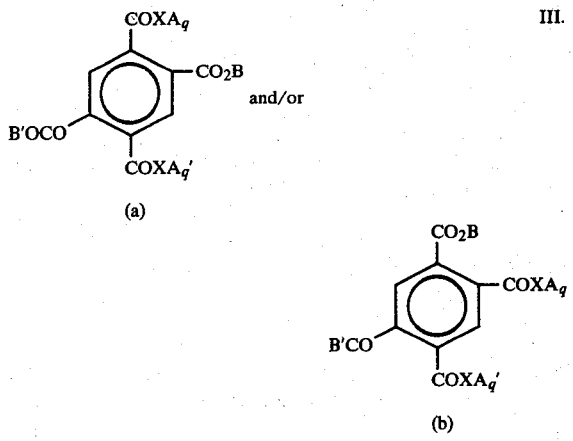

III.

in which X is an oxygen or nitrogen atom, A and A′ are identical or different esterifying or amide-forming radicals, as they have been specified under (1) of the above general definition, q is 1, if X is an oxygen atom, and is 2, if X is a nitrogen atom, and B and B′ are identical or different esterifying radicals, as they have been specified under (2) of the above general definition.

Fluorocarbon resins which are particularly effective and thus preferred have the following formulae:

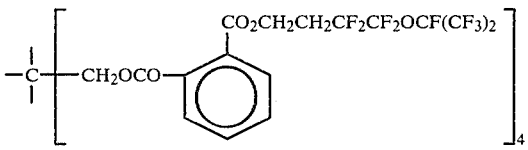

(1)

(2) the above formulae II (a) and/or II (b), in which the radicals A and A′ are each $CH_2CH_2(CF_2)_nOCF(CF_3)_2$, n being any value of from 2 to 8, or the formula $CH_2CH_2(CF_2)_pCF_3$, p being any value of from 5 to 9, and the radical B represents one of the groups $CH_2CH_2OH$, $CH_2CH(OH)CH_2Cl$, $CH_2CH(OH)CH_2OH$,

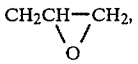

$(CH_2)_4CH(OH)CH_2OH$ or $CH_2CH(OH)CH_2OCH_2CH(OH)CH_2OH$, (3) the above formulae III (a) and III (b), a mixture of the two isomers being present, in which formulae X is an oxygen atom, the radicals A and A′ each represent the group $CH_2CH_2(CF_2)_4OCF(CF_3)_2$, and the radicals B and B′ each represent the group $CH_2CHOHCH_2Cl$, (4) the above formulae III (a) and III (b), in which X is an oxygen atom, the radicals A and A′ represent the group $CH_2CH_2(CF_2)_pCF_3$, in which p is 5, 7 or 9, and the radicals B and B′ represent the group $CH_2CH(OH)CH_2Z$, in which Z is Cl or OH.

The fluorocarbon resins are generally prepared by reacting a benzene-dicarboxylic acid anhydride, which may additionally be substituted, with an appropriate fluorinated alcohol, in which process the semi-ester is formed which contains a fluorinated esterifying radical and a carboxy group. If the compound does not represent an ester, but an amide, the appropriate fluorinated amine is employed as reactant instead of the alcohol. The fluorinated reactant may be prepared according to known methods from the corresponding iodide. For example, fluorinated alkoxyalcohols may be prepared as has been described in U.S. Pat. No. 3,781,370, and the iodide starting materials for these alcohols can be obtained in accordance with U.S. Pat. No. 2,514,487. By a reaction with thionyl chloride, while using known methods, the carboxy groups mentioned above may be converted into carboxy chloride groups, and said chloride may then be converted into a compound of the invention by esterifying the carboxy chloride group with an appropriate alcohol, suitably in the presence of a tertiary amine as promoter or catalyst for the desired esterification.

Another type of reaction which is suitable for the esterification of the above-mentioned carboxy groups is the reaction with the corresponding epoxy compound, wherein the epoxy ring is opened and the carboxy group is esterified.

The compositions of the invention are prepared according to the method described in Example 1 by heating the fluorocarbon resin together with the fatty acid, mono- or diethanolamide and subsequently adding to the fluid the oxyethylated fatty alcohol. In this manner pasty compositions are obtained which have a high stability to storage. They may be brought easily into the form of an aqueous dispersion by pouring hot water (about 40° to 90° C.) over the same. These aqueous dispersions, too, are very fast to storage. The aqueous dispersions thus prepared, which are generally adjusted to a content of fluorocarbon resin of from 0.1 to 10, preferably from 1 to 5% by weight, may be employed in this form for the dirt-repelling finishing of textile material, leather or paper. These dispersions may be applied onto filaments, fibers, flakes or piece goods, especially onto material of this kind made of polyester and polyamide. The application is carried out by slop padding, blade coating, padding, dipping or rinsing. A further method of application consists in incorporating the above-described compositions into fiber conditioning agents, especially into texturing compositions, which contain the constituents that are common for this purpose, such as mineral oils, diester oils and antistatic agents. The texturing compositions are applied onto the fiber after spinning, and by the subsequent drawing and texturing the fluorocarbon resins are firmly anchored onto the fiber.

The following Examples serve to illustrate the invention.

EXAMPLE 1

Preparation of a fluorocarbon resin dispersion (a) 50 Grams of fluorocarbon resin are heated with 100 g of acetaminoethanol for 2 minutes to 170° C. At a temperature of from 80° to 100° C. 100 g of a reaction product of 1 mol of coconut oil alcohol and 25 mols of ethylene oxide are introduced into the clear liquid by stirring, until the constituents are completely melted. After cooling there remains a light yellow paste which is diluted with water of 60° C. to give an aqueous dispersion with 5% of fluorocarbon resin.

(b) In the same manner as described under (a), the following stock mixture is prepared with the same active ingredient:

50 g of fluorocarbon resin,
200 g of coconut oil acid diethanolamide,
200 g of a reaction product of 1 mol of stearyl alcohol and 15 mols of ethylene oxide.

The pasty stock mixture is brought into a dispersion containing 5% of fluorocarbon resin by means of water of 50° C.

The fluorocarbon resin used has been prepared by reacting one mol of pyromellitic anhydride with two moles of a compound of the formula $$HO(CH_2)_2(CF_2)_4OCF(CF_3)_2$$

Conditions: 1.177 mol ratio of anhydride:alcohol, in dry dimethyl formamide solvent, 24 hr at 60° C. with stirring.

Work-up: Add ice water, filter off the crystalline product dry over night at 70° C. in vacuo.

Intermediate: Fluorinated isopropoxyhexyl diester of pyromellitic acid (1:1 mixture of isomers with general formula III(a) and III(b) except having (COOH) instead of $CO_2B$).

Properties: m.p. 130°–140° C.; milliequiv. COOH per gram (by alc. KOH titration) = 1.88 (theory = 1.86).

This intermediate is further reacted with epichlorohydrine

Conditions: Stirred 30 hr. at 65° C. in dry acetonitrile using a little pyridine as promoter or catalyst of ester formation.

Work-up: Evaporate volatiles (form 2-phase liquid) at 80° C./1 mm.

Product: Viscous liquid, difluoroester dichlorhydrin of pyromellitic acid, having general formula III(a) and III(b) in 1:1 proportions of each, wherein:

X=oxygen, q=1

$A=(CH_2)_2(CF_2)_4OCF(CF_3)_2$ $A'=(CH_2)_2(CF_2)_4, OCF(CF_3)_2$ $B=CH_2CH(OH)CH_2Cl$ $B'=CH_2CH(OH)CH_2Cl$

EXAMPLE 2

Polyester fabrics are padded with dispersions of 5% strength each according to Examples 1*a* and 1*b* with a squeezing effect of about 80% (tests Nos. 1 and 2). For reasons of comparison (No. 3) the same fluorocarbon resin was dispersed in water with use of a polymeric anionic dispersing agent such as lignosulfonate, the content of active ingredient being the same as above. In this test the fluorinated agent was always separated and formed only an irregular deposit on the PES fabric.

The fabrics are tested for their oil-repellency, as it has been described in Textil-Praxis International 1972, pages 499 to 503, the value 100 standing for a high oil-repellency and the value 0 for no oil-repellency. The following values were obtained:

| | Unwashed | 5 times washing at 40° C. |
|---|---|---|
| 1 | 100 | 90 |
| 2 | 110 | 100 |
| 3 | 90–70 | 50 |

EXAMPLE 3

The dispersion obtained according to Example 1 a was applied by means of a lick roller to a polyamide-6 filament bundle which is drawn in the cold to dtex 70 f 32. The amount of dispersion applied is about 1%. Subsequently the PA6 filament was spin textured without problems at 210° C., and tubular knitted goods were manufactured from the same.

An examination of the oil-repellency effect showed the high value of 100.

What is claimed is:

1. Dispersible composition of fluorocarbon resins which consists of (a) from 1 to 10 parts by weight of a compound of the general formula

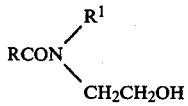

in which R is $C_8$–$C_{22}$ alkyl or alkenyl and $R^1$ is hydrogen or hydroxyethyl, (b) from 1 to 10 parts by weight of a compound of the general formula $$R—(O—CH_2—CH_2)_x—OH$$

in which R is $C_8$–$C_{22}$ alkyl or alkenyl and x is a number of from 15 to 50, and (c) 1 part by weight of a fluorocarbon resin consisting of at least one fluorinated compound with at least one benzene nucleus and (1) one or two carbonyl groups as substituents at this benzene nucleus, wherein the carbonyl groups are bound via an oxygen or a nitrogen atom to a perfluoroalkyl or perfluoroalkylene-oxyperfluoroalkyl radical of from 2 to 20 carbon atoms and, if each benzene nucleus does not contain more than one carbonyl group of this kind, the number of benzene nuclei is at least 2, and (2) further carbonyl groups arranged each in the ortho-position to a carbonyl group, and only to one of the first-mentioned carbonyl groups, the number of the former group not exceeding the number of the first-mentioned carbonyl groups, these additional carbonyl groups being bound each via an oxygen atom at an esterifying bivalent alkylene radical of from 1 to 5 carbon atoms which binds the oxygen atom to (a) at least one further benzene nucleus substituted in similar manner, or (b) an alkyl group of from 1 to 5 carbon atoms substituted at least once by a hydroxyl group, a halogen atom or a terminal epoxy ring, or (c) two alkyl groups of this kind which are bound to each other by an oxygen atom.

2. A composition as claimed in claim 1, wherein the fluorocarbon resin has the general formula

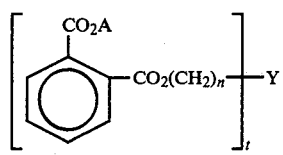

I.

in which n is a number of from 1 to 4, t is a number of from 2 to 4, Y is CHOH, CH, COH or C, and A is a fluorinated esterifying radical as it has been defined in claim 1, paragraph (1).

3. A composition as claimed in claim 1, wherein the fluorocarbon resin has the general formula

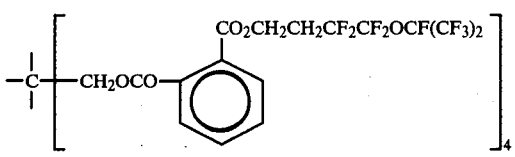

(1)

4. A composition as claimed in claim 1, wherein the fluorocarbon resin has the general formula

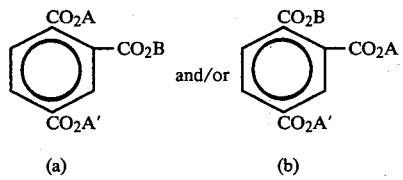

II.

in which A and A′ represent identical or different fluorinated esterifying radicals, as they have been defined in claim 1, paragraph (1), and B is an esterifying radical, as it has been defined in claim 1, paragraph (2).

5. A composition as claimed in claim 1, wherein the fluorocarbon resin has the general formula given in claim 4 and in which the radicals A and A′ are each $CH_2CH_2(CF_2)_nOCF(CF_3)_2$, n being any value of from 2 to 8, or the group $CH_2CH_2(CF_2)_pCF_3$, p being any value of from 5 to 9, and the radical B represents one of the groups $CH_2CH_2OH$, $CH_2CH(OH)CH_2Cl$, $CH_2CH(OH)CH_2OH$,

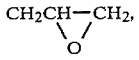

$(CH_2)_4CH(OH)CH_2OH$ or $CH_2CH(OH)CH_2OCH_2CH(OH)CH_2OH$.

6. A composition as claimed in claim 1, wherein the fluorocarbon resin has the general formula

III.

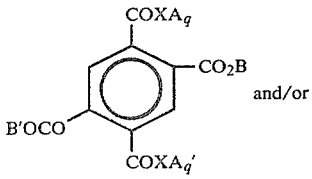

and/or (a)

-continued

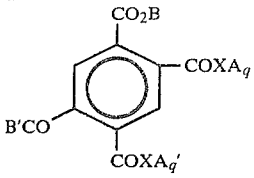

(b)

in which X is an oxygen or nitrogen atom, A and A' are identical or different esterifying or amide-forming radicals, as they have been defined in claim 1, paragraph (1), q is 1, if X is an oxygen atom, and is 2, if X is a nitrogen atom, and B and B' are identical or different esterifying radicals, as they have been defined in claim 1, paragraph (2).

7. A composition as claimed in claim 6, wherein the fluorocarbon resin is a mixture of compounds of the general formulae III (a) and III (b), in which X is an oxygen atom, the radicals A and A' each represent the group $CH_2CH_2(CF_2)_4OCF(CF_3)_2$, and the radicals B and B' each represent the group $CH_2CHOHCH_2Cl$.

8. A composition as claimed in claim 6, wherein the fluorocarbon resin is a mixture of compounds of the general formulae III (a) or III (b), in which X is an oxygen atom, the radicals A and A' represent the group $CH_2CH_2(CF_2)_pCF_3$, p being the number 5, 7 and 9, and the radicals B and B' represent the group $CH_2CH(OH)CH_2Z$, Z being Cl or OH.

9. A composition as claimed in claim 1, wherein x is a number of from 20 to 30.

* * * * *